US011427987B2

(12) United States Patent
Furxer et al.

(10) Patent No.: US 11,427,987 B2
(45) Date of Patent: Aug. 30, 2022

(54) HYDRAULIC SYSTEM FOR A FALL-BACK SUPPORT AND WORK MACHINE

(71) Applicant: Liebherr-Werk Nenzing GmbH, Nenzing (AT)

(72) Inventors: Martin Furxer, Nueziders (AT); Markus Schwarzhans, Schruns (AT)

(73) Assignee: Liebherr-Werk Nenzing GmbH, Nenzing (AT)

( * ) Notice: Subject to any disclaimer, the term of this patent is extended or adjusted under 35 U.S.C. 154(b) by 0 days.

(21) Appl. No.: 17/377,228

(22) Filed: Jul. 15, 2021

(65) Prior Publication Data

US 2022/0025613 A1 Jan. 27, 2022

(30) Foreign Application Priority Data

Jul. 21, 2020 (DE) ..... 20 2020 104 190.8

(51) Int. Cl.
*E02F 9/22* (2006.01)
*F15B 15/14* (2006.01)
*F15B 20/00* (2006.01)

(52) U.S. Cl.
CPC ..... *E02F 9/2278* (2013.01); *E02F 9/2225* (2013.01); *E02F 9/2267* (2013.01); *F15B 15/1428* (2013.01); *F15B 20/004* (2013.01)

(58) Field of Classification Search
CPC ..... B66C 23/92; E02F 9/2278; E02F 9/2225; E02F 9/2267
See application file for complete search history.

(56) References Cited

U.S. PATENT DOCUMENTS

| | | | | |
|---|---|---|---|---|
| 6,951,103 | B2 * | 10/2005 | Berthod | E02F 9/2207 60/413 |
| 7,140,178 | B2 * | 11/2006 | Bitter | F15B 11/003 60/413 |
| 7,530,434 | B2 * | 5/2009 | Bitter | F15B 1/021 60/413 |
| 2018/0134528 | A1 * | 5/2018 | Oka | B66C 13/20 |

FOREIGN PATENT DOCUMENTS

| | | | |
|---|---|---|---|
| EP | 1375926 | A1 | 1/2004 |
| EP | 1574626 | A1 | 9/2005 |
| EP | 1659087 | A2 | 5/2006 |
| FR | 2923352 | A1 | 5/2009 |
| JP | 05278995 | A * | 10/1993 |
| JP | H05278995 | A | 10/1993 |
| JP | 2000318982 | A * | 11/2000 |
| JP | 2009067578 | A * | 4/2009 |
| JP | 2009067578 | A | 4/2009 |

* cited by examiner

*Primary Examiner* — Thomas E Lazo
(74) *Attorney, Agent, or Firm* — McCoy Russell LLP

(57) ABSTRACT

A hydraulic system for operating a hydraulic fall-back support of a work machine including at least one hydraulic fall-back support cylinder for tracking and limiting movements of a boom of the work machine and a hydraulic pump by means of which the fall-back support cylinder and at least one further hydraulic consumer can be supplied with hydraulic fluid. A stop valve having a blocking position and a passage position is connected between the hydraulic pump and the fall-back support cylinder, by means of which the stop valve and a load-bearing cylinder space of the fall-back support cylinder is blockable and a hydraulic store connected to the load-bearing cylinder space is provided between the stop valve and the fall-back support cylinder.

16 Claims, 3 Drawing Sheets

HYDRAULIC SYSTEM FOR A FALL-BACK SUPPORT AND WORK MACHINE

CROSS REFERENCE TO RELATED APPLICATION

The present application claims priority to German Patent Application No. 20 2020 104 190.8 filed on Jul. 21, 2020. The entire contents of the above-listed application is hereby incorporated by reference for all purposes.

TECHNICAL FIELD

The present invention relates to a hydraulic system for operating a hydraulic fall-back support of a work machine and to a work machine, in particular a mobile crane or cable excavator, having such a hydraulic system.

BACKGROUND AND SUMMARY

It is known for a number of work machines such as crawler cranes or cable excavators to use so-called fall-back supports to increase operational safety under difficult weather conditions. To illustrate the principle of a fall-back support, FIG. 1 shows a crawler crane 1 in a side view. The crane 1 has an undercarriage 2 having a traveling gear (e.g. a crawler traveling gear, a crawler chain traveling gear, etc.) and a superstructure 3 which is supported on the undercarriage 2 and is rotatable about a vertical axis and to which a boom 4 is pinned. The boom 4 is pivotable about a horizontal axis so that its angle of inclination relative to the superstructure 3 is adjustable. The adjustment of the boom 4 takes place via a retraction rope 5 by means of a retraction winch 6. A load suspension means 7 or a crane hook is connected to a hoist winch 9 via a hoist rope 8. The free length of the hoist rope 8 can be changed by actuating the hoist winch 9 to raise or lower lifting loads attached to the load suspension means 7.

The weight force of the boom 4 together with the lifting load produces a load torque M acting counterclockwise about the pivot point of the boom 4 at the superstructure 3. This load torque M counteracts the rope force of the retraction rope 5, whereby the latter is tightened and the boom 4 is held at a defined angular position to the superstructure 3.

The boom 4 provides a large exposed surface to the wind. Wind load from the front (from the left in FIG. 1) thus counteracts the load torque M and reduces the rope force in the retraction rope 5. There is thereby a risk that the load torque M is exceeded; the consequence is slackline formation of the retraction rope 5 and in the extreme case a turning over of the boom 4 to the rear, which would result in damage to the machine and personal injury. It is known as a countermeasure to limit the maximum achievable boom angle by a mechanical abutment or by a switching off of the retraction winch 6 in good time to values below 90°. A maximum wind speed can furthermore be defined as the point at which the machine operation is to be stopped and the boom 4 is to be placed on the ground.

To be able to allow steeper boom angles and withstand higher wind speeds, the use of fall-back supports 12 has proven itself: hydraulically operated cylinders whose force supports the effect of the load torque M and that are arranged between the boom 4 and the superstructure 3. The fall-back support cylinder or cylinders 12 have constant contact with the boom 4 and follow all of its movements. The movements may be caused by the activity of the retraction winch 6 (i.e. working movements with a large cylinder stroke—typically in the range of a plurality of decimeters) or smaller movements such as from an elastic deformation of the total system due to load change reactions on the raising or lowering of lifting loads (i.e. very small movements with a very small cylinder stroke—typically in the range of a few centimeters).

The energy supply of the fall-back supports typically takes place with known units by means of hydraulic pumps that are installed expressly for this purpose and that build up pressure in the fall-back support cylinders over the total activation time. In this respect, the piston surfaces of the fall-back support cylinders are typically permanently acted on in working operation by pressure of the hydraulic pumps expressly provided. In an advantageous and proven embodiment, these pumps are controlled as required (so-called "load sensing") so that they adapt the oil conveying amount to the movement state of the fall-back support cylinders at a constant pressure and thereby keep the power effort within limits.

A disadvantage of such known energy supply systems is that every installed hydraulic pump consumes a basic load (bearing friction, churning losses, energy requirements of regulating devices, etc.) during 100% of the activation time and so reduces the efficiency of the total work machine. This circumstance was usually ignored in the past with diesel-operated machines. However, efforts to avoid unnecessary emissions are increasing with higher economic and technical interest in saving basic load, for example, with electric drives having rechargeable batteries. Construction space and the number of pump installation positions at the primary energy source are furthermore also limited.

Against this background, it is the underlying object of the present invention to reduce the energy requirements for the provision of the fall-back support function and to ensure an energy-efficient balance of minimal movements of the boom for such work machines.

A hydraulic system for operating a hydraulic fall-back support of a work machine that comprises at least one hydraulic fall-back support cylinder for tracking and limiting movements of a boom of the work machine and a hydraulic pump by means of which the at least one fall-back support cylinder and at least one further hydraulic consumer can be supplied with hydraulic fluid is accordingly provided. The hydraulic pump is not exclusively provided for the supply of the fall-back support cylinder. It rather serves as the primary energy source of the supply of the most varied consumers such as radiator drives, winches, or the like and is additionally used to supply the fall-back support function.

Further provided is a stop valve connected between the hydraulic pump and the fall-back support cylinder that can adopt a blocking position and a passage position and by means of which a load-bearing cylinder space of the fall-back support cylinder can be blocked.

The load-bearing cylinder space of the fall-back support cylinder can be blocked by switching the stop valve into the blocking position to prevent the energy exchange with the remainder of the hydraulic system. That hydraulic pressure is thereby present in the blocked region or in the load-bearing cylinder space that was present at the time of the blocking of the stop valve. The hydraulic pump thus now no longer has to provide any energy for the fall-back support function if no movement of the boom is intended to take place, which reduces the energy requirement or the basic load of the primary energy source and increases the overall efficiency. With an active movement of the boom, i.e. a movement desired by the operator of the work machine, the stop valve can be switched into the passage position to enable a conducting in and out of hydraulic fluid and thus to enable a tracking of the fall-back support cylinder.

Since the boom is not moved via the fall-back support cylinder, but rather via a setting device, for example a retraction winch, no energy has to be provided by the hydraulic pump for the raising of the boom either, that is on the retraction of the piston rod of the fall-back support cylinder, but rather hydraulic fluid only has to be conducted off or has to be supplied to a tank while maintaining a specific pressure in the load-bearing cylinder space. A supply via the hydraulic pump only has to be provided on the extension of the fall-back support cylinder, that is, on the lowering of the boom. The same can apply to an installation operation when the fall-back support cylinder is released from the boom.

Provided is a hydraulic store connected to the load-bearing cylinder space between the stop valve and the fall-back support cylinder. Very small movements of the boom can thereby be compensated even when a load-bearing cylinder space is blocked with the aid of the stop valve and thus decoupled from the hydraulic pump or from a tank. The fall-back support cylinder can thus follow very small movements of the boom, with the hydraulic fluid flow required for this being removed from or supplied to the hydraulic store.

In an embodiment, at least two fall-back support cylinders are provided each having a stop valve and a hydraulic store that can together be supplied with hydraulic fluid by the hydraulic pump.

In a further embodiment, a pressure relief valve is provided between the stop valve and the fall-back support cylinder. This can in particular serve the pressure backup on malfunctions and is therefore not involved in the function of the fall-back support in normal operation. However, it is also conceivable that the pressure relief valve is used to control or regulate the pressure and the conveying amount of the hydraulic fluid flow from and to the fall-back support with a simultaneously open stop valve, i.e. a stop valve in the passage position, to keep the hydraulic pressure in the load-bearing cylinder space in an optimum range on a tracking of the boom. The value of the maximum pressure ensured by the pressure relief valve can be set.

In a further embodiment, a check valve is provided that blocks the region of the hydraulic system blockable by the stop valve in the direction of the hydraulic pump. The check valve can here be connected in parallel with the stop valve, that is independently of the switched state of the stop valve in operation, or can only be acted on in the blocking position of the stop valve, i.e. can only be used when the stop valve is in the blocking position. In the latter case, the check valve can in particular be part of the stop valve. It is in particular possible with the check valve to first establish a pressure equalization on both sides of the stop valve before an opening of the fall-back support cylinder on a movement of the boom and thereby to reduce or avoid load change reactions on the transitions between different operating phases.

Provision is made in a further embodiment that a further valve, for example an electrically switchable valve, is arranged between the stop valve and the hydraulic pump. The valve can be a directional valve, in particular a 4/2 way valve or a 4/3 way valve. A possible function of the additional valve is the decoupling of the stop valve from the hydraulic pump or from the tank. It is alternatively or additionally conceivable that it is used to control or regulate the pressure and the conveying amount of the hydraulic fluid flow from and to the fall-back support with a simultaneously open check valve to keep the hydraulic pressure in the load-bearing cylinder space in an optimum range on a tracking of the boom. The valve can be electronically controllable. With a plurality of fall-back support cylinders, only a single such valve is preferably provided.

Provision is made in a further embodiment that the load of the fall-back support cylinder can be sensed by means of a load measurement device that comprises a pressure sensor arranged between the stop valve and the fall-back support cylinder. A load sensing application can thereby be implemented. It is in particular thereby possible to control or regulate the pressure and the conveying amount of the hydraulic fluid flow from and to the fall-back support and to enable an optimum tracking of the fall-back support cylinder.

In a further embodiment, a pressure setting device is provided by means of which the pressure and the volume flow or conveying amount to and from the fall-back support cylinder are settable and can be regulated in dependence on a measured load of the fall-back support cylinder. The hydraulic pressure in the load-bearing cylinder space of the fall-back support cylinder can thereby be held in an optimum range on a tracking of the boom. On the retraction of the fall-back support cylinder, in particular due to a corresponding active movement of the boom, a resistance is generated by the pressure setting device that ensures an optimum tracking while maintaining the fall-back support function.

Provision is made in a further embodiment that the pressure setting device comprises a recuperation device at/in the fall-back support cylinder in which hydraulic fluid flows off onto the opposite side of the fall-back support cylinder piston, at least one pressure relief valve that is arranged between the stop valve and the hydraulic pump and that is in particular electrically controllable, a load sensing arrangement, and/or a means to control a previously described valve arranged between the hydraulic pump and the stop valve. The control or regulation of the last named valve can take place hydraulically mechanically or in a software supported electrical manner. Values of a load sensing arrangement can be taken into account in this process.

Provision is made in a further embodiment that the stop valve is hydraulically controllable by means of a switching valve that is in particular electrically controllable. The switching valve is preferably arranged between the hydraulic pump and a control connection of the stop valve and can, for example, have a blocking position and a passage position.

Provision is made in a further embodiment that the stop valve is hydraulically controllable and has a control connection that is connected to the output of a hydraulic shuttle valve, with an input of the shuttle valve being connected to a non-load bearing cylinder space of the fall-back support cylinder and with the other input being connected to a switching valve that is in particular electrically controllable. It is possible with the aid of the shuttle valve to switch the stop valve in two manners: either by acting on the non-load bearing cylinder space of the fall-back support cylinder (for example in an installation operation) or by controlling the switching valve (for example in a normal operation in which no pressure actuation of the non-load bearing cylinder space takes place, but rather a retraction of the fall-back support cylinder takes place by "bumping" the actuated boom).

Provision is made in a further embodiment that the hydraulic store is configured to compensate very small movements of the fall-back support cylinder with a load-bearing cylinder space blocked by the stop valve by removing and discharging hydraulic fluid. This in particular takes place at a moderate pressure and thus force change in accordance with the charge characteristic of the hydraulic store.

The present invention further relates to a work machine, in particular to a mobile crane or cable excavator, comprising a pivotable boom, a setting device for adjusting the boom, at least one fall-back support cylinder connected to the boom and following its movements, and a hydraulic system in accordance with the invention for the operation of the at least one fall-back support cylinder. In this respect, the same advantages and properties obviously result as for the hydraulic system in accordance with the invention so that a repeat description will be dispensed with at this point.

Provision is made in an embodiment that the stop valve is in the blocking position and locks a load-bearing cylinder space of the fall-back support cylinder when the boom is not actively moved by means of the setting device. The energy consumption or the basic load is thereby reduced when the boom is not moved by the operator.

A control is provided in a further embodiment by means of which the stop valve and preferably the setting device are indirectly or directly controllable and that is configured to switch the stop valve into the passage position on actuation of the setting device so that hydraulic fluid can be conveyed to the load-bearing cylinder space or can be conducted away from it to keep the pressure in an optimum range for the purpose of a tracking of the boom.

A further valve arranged between the stop valve and the hydraulic pump and one check valve per fall-back support cylinder as described above are provided in a further embodiment, with the control being configured to receive a signal for actuating the setting device from an input unit for the purpose of a movement of the boom, to thereupon switch the valve into a passage position, and to leave the stop valve in the blocking position, to switch the stop valve into the passage position after opening the check valve (and optionally to close the further valve), and subsequently to actuate the setting device. A sufficient pressure in the non-blocked region of the hydraulic system can thereby first be built up by the hydraulic pump. As soon as the check valve is opened (and thus a pressure equalization is established), the stop valve is opened so that on a subsequent movement of the boom that results in a retraction or extension of the fall-back support cylinder, hydraulic fluid can correspondingly be conveyed into or conducted out of the load-bearing cylinder space.

BRIEF DESCRIPTION OF THE FIGURES

Further features, details, and advantages of the invention result from the embodiments explained in the following with reference to the Figures. There are shown.

DETAILED DESCRIPTION

Figure 1:
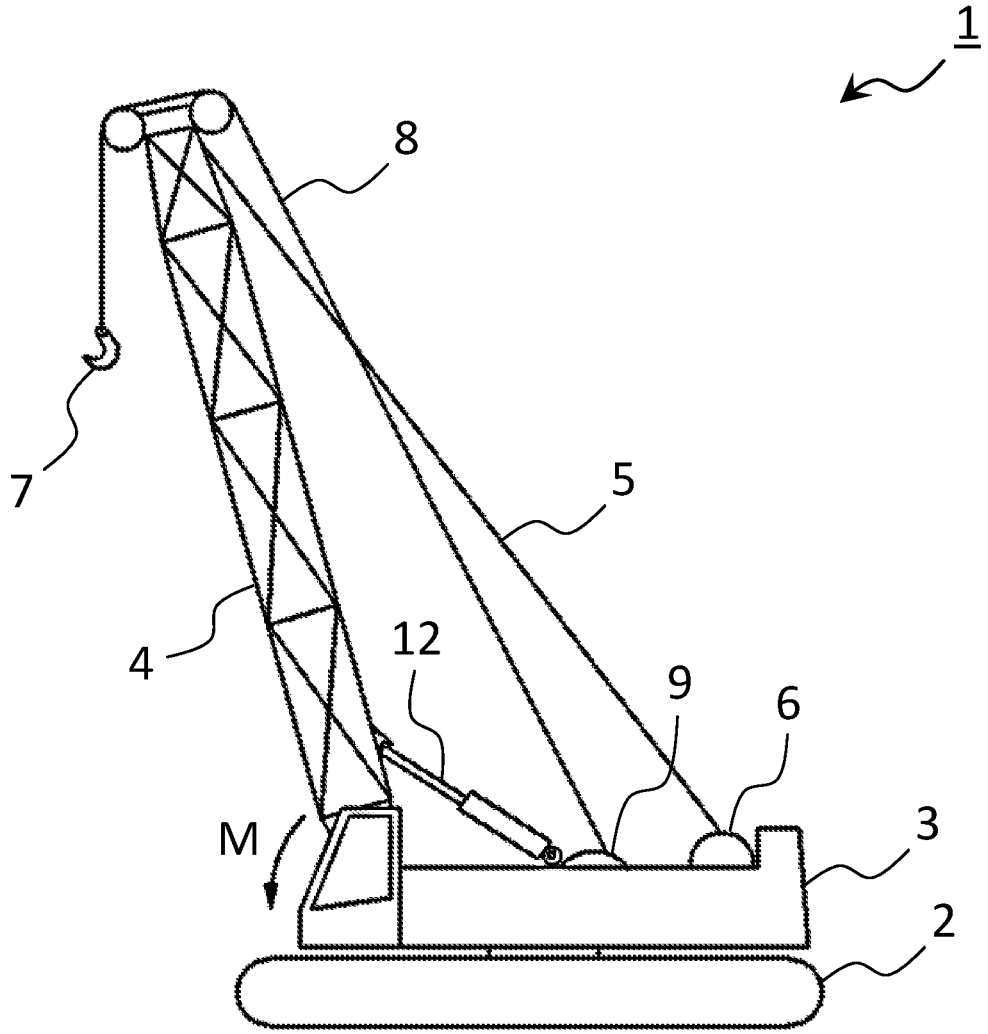
FIG. 1: a crawler crane of the category having a fall-back support in a side view.

FIG. 1 shows a schematic side view of a crawler crane 1 and has already been initially described so that repeat explanations will be dispensed with at this point. The work machine 1 in accordance with the invention can in principle be such a crawler crane that in contrast with known machines is equipped with a hydraulic system 10 as described in the embodiments herein. In the crawler crane 1 shown in FIG. 1, the retraction winch 6 arranged on the superstructure 3 represents the setting device. It is furthermore possible that an A frame is connected in an articulated manner pivotable about a horizontal axis to the superstructure 3, is coupled to the boom 4 via guying means, for example guying rods, and is pivotable together with the guying means by actuation of the retraction winch 6. However, other boom configurations and setting devices are also conceivable for the boom movement without this having any influence on the function of the fall-back support or of the hydraulic system 10 in accordance with the invention.

Figure 2:
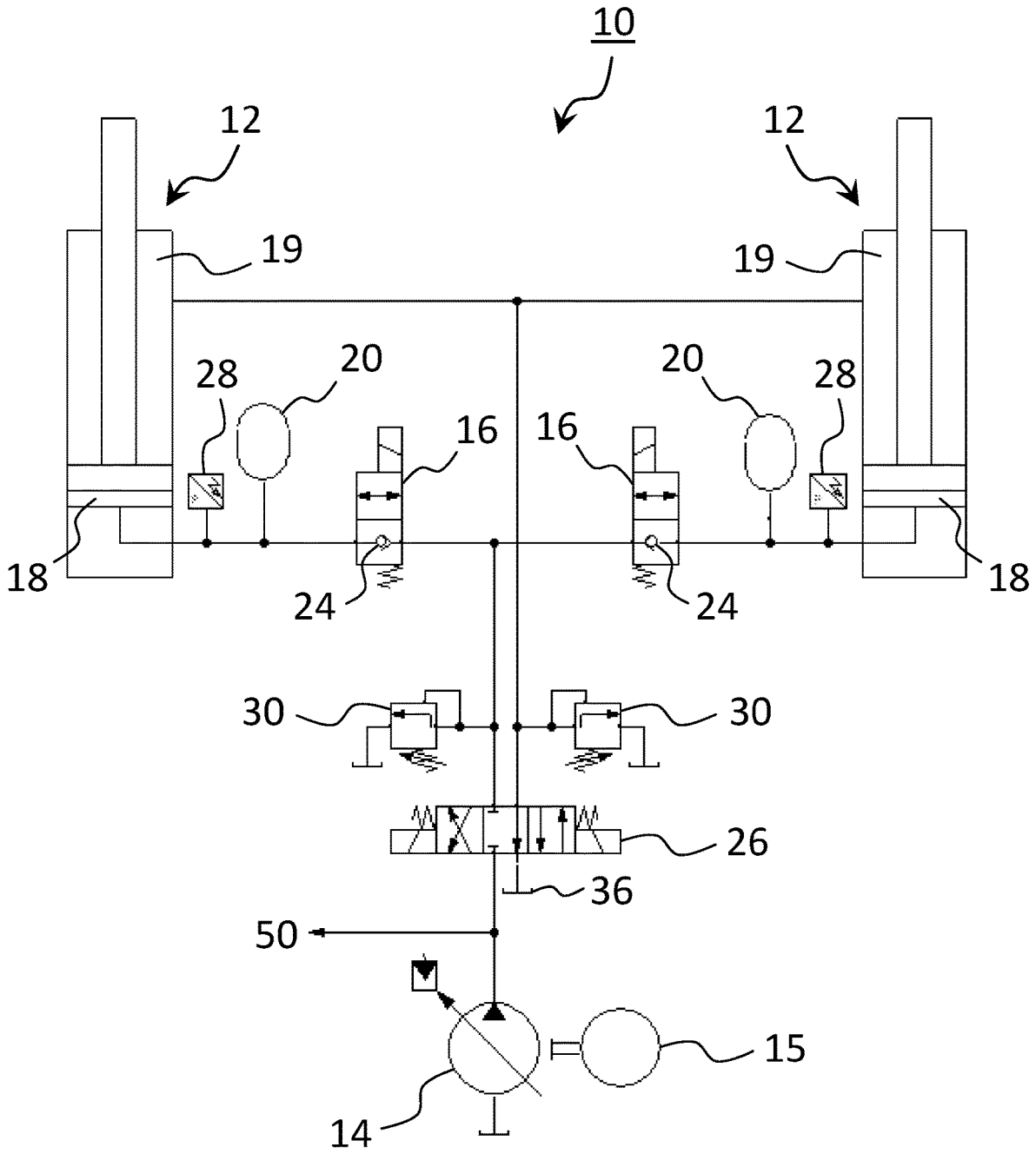
FIG. 2: a circuit diagram of a first embodiment of the hydraulic system in accordance with the invention.

A circuit diagram of the hydraulic system 10 in accordance with a first embodiment is shown in FIG. 2. The hydraulic system 10 serves the operation of the fall-back support function of a work machine 1, with a crawler crane 1 in accordance with FIG. 1 being assumed for the two embodiments discussed in the following. A hydraulic pump 14 that is driven by a motor 15 and that operates a number of hydraulic consumers 50 not shown in more detail serves as the primary energy source. Said hydraulic consumers 50 can, for example, be radiator drives or winches such as the hoist rope and the retraction winches 6, 9. In accordance with the invention, the hydraulic pump 14 additionally supplies two fall-back support cylinders 12 whose piston rods are pivotably coupled to the boom 4 of the work machine 1.

Instead of the system configuration shown here with two symmetrically connected fall-back support cylinders 12, other configurations are naturally also possible with only one or more than two fall-back support cylinders 12. The exact design of the primary energy source 14, 15 is not relevant to the function of the invention. The function of the hydraulic system 10 will be explained with reference to one of the two symmetrical branches in the following.

The fall-back support cylinder 12 is separated from the output of the hydraulic pump 14 by an electrically switchable stop valve 16 that has a blocking position and a passage position. In the blocking position, a check valve 24 blocks the load-bearing cylinder space 18 of the fall-back support cylinder 12; the blocking direction therefore faces the hydraulic pump 14. In the passage position, a supply or a conducting away of hydraulic fluid to and from the fall-back support cylinder 12 can take place. A hydraulic store 20 and a pressure sensor 28 are located between the blocking valve 16 and the fall-back support cylinder 12, that is, in the blockable region.

An electrically switchable 4/3 way valve 26 connects the hydraulic pump 14 to the hydraulic lines that lead to the stop valve 16 and to the non-load bearing cylinder space or annular space 19 of the fall-back support cylinder 12. In FIG. 2, the directional valve 26 is in the (middle) blocking position so that the connection between the hydraulic pump 14 and the blocking valve 16 is deactivated. The switching position "cross" of the directional valve 26 arranged at the left in the drawing is not required in normal operation since a retraction of the fall-back support cylinder 12 does not take place hydraulically, but rather by agency of the actively actuated boom 4. This switching position is required, for example, for an installation operation in which the work machine is partially dismantled for transport, i.e. the boom 4 is removed from the superstructure 3, and the fall-back support cylinder 12 projecting beyond the superstructure 3 is retracted to establish a shipping readiness. With a work machine without a transport situation or without installation operation, the use of a simple 4/2 way valve without a cross position would also be possible.

A pressure relief valve 30 is furthermore arranged between the directional valve 26 and the stop valve 16. A further such valve 30 is located in the line that connects the directional valve 26 to the annular space 19. The value of the maximum pressure limited by the pressure relief valve is electrically settable. It is possible by means of the pressure relief valve 30 in interaction with the directional valve 26 to control the pressure and the conveying amount of the hydraulic fluid flow or of the oil flow to and from the fall-back support cylinder 12.

All of the electrically switchable or regulable valves 16, 26, 30 are controlled by a controller of the work machine 1 that in particular likewise takes over the control of different actuators of the work machine 1 such as the hoist winch 9 or the retraction winch 6. The controller additionally receives values of the pressure sensor 28 with respect to the pressure present in the load-bearing cylinder space 18 of the fall-back support cylinder 12, whereby a load sensing function is implemented. Further sensors can be provided inside and/or outside the hydraulic system 10 for this purpose.

Unlike known systems with a fall-back support function, no permanent supply of the fall-back support cylinder 12 via an expressly provided hydraulic pump has to take place in the hydraulic system 10 in accordance with the invention. Instead, the hydraulic pump 14 of the work machine 1 is used to provide energy for the fall-back support function in certain situations. If the boom 4 is not moved by actuation of the retraction winch 6, the load-bearing cylinder space 18 and the region connected to the pressure sensor 28 and to the hydraulic store 20 is blocked by the stop valve 16 so that no energy exchange with the remaining system takes place. The cylinder pressure present before the last switching of the stop valve 16 into the blocking position is thus maintained in the closed volume. Only the remaining consumers 50 are then supplied by the hydraulic pump 14.

The hydraulic store 20 is provided to nevertheless ensure a fall-back support function of the boom 4 on minimal movements of the boom 4 with a blocked load-bearing cylinder space 18 caused by external forces, for example on the raising or lowering of lifting loads, gusts of wind, etc. The required hydraulic fluid flow is removed on the extension of the fall-back support cylinder 12 or is added on the retraction of the fall-back support cylinder 12 so that the fall-back support cylinder 12 can follow the very small movements of the boom 4. The hydraulic store 20 thus acts both as an energy source and as an energy sink for micro-movements of the boom 4.

Upon actuation of the retraction winch 6 by the operator for the purpose of an active movement of the boom 4, the stop valve 16 is opened, i.e. is switched into the passage position. On the lowering of the boom 4, that is, on an extension of the fall-back support cylinder 12, the required pressure to track the boom 4 can be maintained or set in the hydraulic store 20 or in the load-bearing cylinder space 18 by supplying hydraulic fluid. The directional valve 26 is also switched into a passage position for this purpose. On the raising of the boom 4, that is, on the retraction of the fall-back support cylinder 12, the directional valve 26 remains in the blocking position so that hydraulic fluid from the load-bearing cylinder space 18 is now conducted away to the tank 36 against the resistance generated by the pressure relief valve 30. An optimum tracking of the fall-back support cylinder 12 can also be ensured on the raising of the fall-back support cylinder 12 due to the settable resistance of the pressure relief valve 30.

A supply of the fall-back support cylinder 12 by the hydraulic pump 14 thus only has to take place during the lowering of the boom 4 or in an optionally provided installation operation. Provision can optionally be made that on the lowering of the boom 4, the stop valve 16 is not switched into the passage position, but the hydraulic fluid supply rather takes place via an opening of the check valve 24.

The check valve 24 inter alia has the function of reducing a load change reaction occurring on an operating phase change, but is not absolutely necessary. An advantageous operating method of the hydraulic system 10 on the raising of the boom 4 will be described in the following. In the starting position, in which no active movement of the boom 4 takes place, the stop valve 16 and the directional valve 26 are each in the blocking position so that the hydraulic line between valves 16, 26 is pressureless. The line between the stop valve 16 and the fall-back support cylinder 12 is in contrast acted on by stored pressure. The operator of the work machine 1 would now want to raise the boom 4 or set it steeper and makes a corresponding input via an input unit.

In some aspects, the control switches the directional valve 26 into the passage position ("parallel" position), whereby the pressure in the line up to the stop valve 16, that is, the pressure applied to the check valve 24, increases. If the pressure generated by the hydraulic pump 14 exceeds the store pressure in the blocked region, the check valve 24 opens and pressure equilibrium with the hydraulic store is established 20. The directional valve 26 can optionally be closed after this point in time.

The control only then switches the stop valve 16 into the passage position. This step can, however, optionally be omitted and a supply of hydraulic fluid can take place via the check valve 24 as required (i.e. on a falling below of the minimum permitted cylinder force). The retraction winch 6 is subsequently actuated to raise the boom 4. The fall-back support cylinder 12 is thereby retracted against the resistance of the pressure relief valve 30 so that a tracking by the fall-back support cylinder 12 takes place at a corresponding pressure in the load-bearing cylinder space 18 or on a corresponding retaining force.

Figure 3:
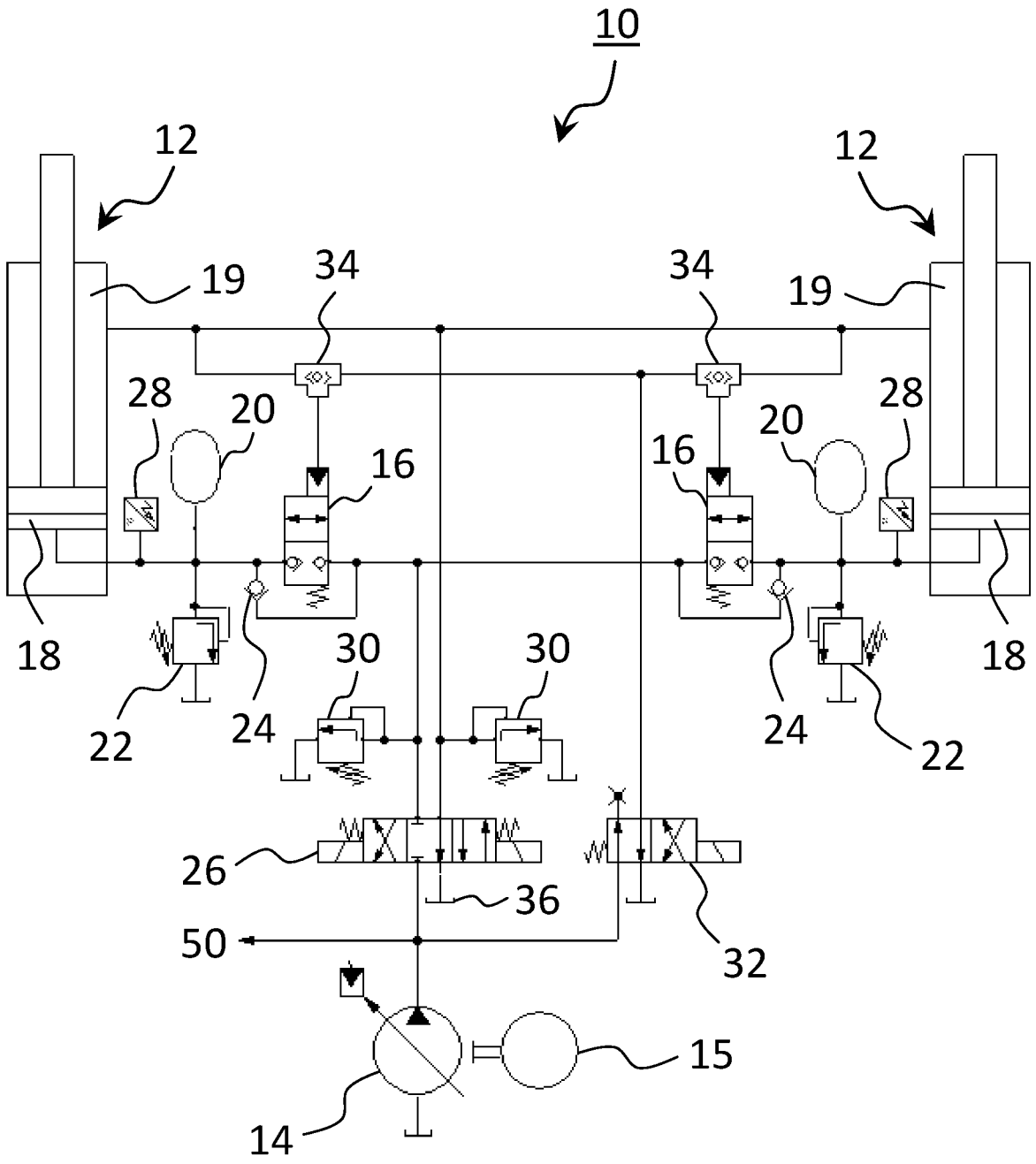
FIG. 3: a circuit diagram of a second embodiment of the hydraulic system in accordance with the invention.

FIG. 3 shows a second embodiment of the hydraulic system 10 in accordance with the invention. In comparison with the first embodiment of FIG. 2, the stop valve 16 preloaded into the blocking position is here hydraulically switchable and is connected at the control input to the output of a hydraulic shuttle valve 34. The shuttle valve 34 is connected to the annular space 19 of the fall-back support cylinder 12 at an input so that the stop valve 16 can be switched into the passage position by a targeted pressure exertion on the annular space 19. However, this does not take place in normal working operation of the work machine 1 since a retraction of the fall-back support cylinder 12 takes place mechanically via the boom 4.

The other input of the shuttle valve 34 is connected to an electrically switchable switching valve 32. The stop valve 16 can be switched into the passage position by controlling the switching valve 32 by the control. Said stop valve 16 has no check valve in the blocked position, but the check valve 24 is here rather permanently connected in parallel. The function of the hydraulic system 10, however, corresponds to the function shown as part of the first embodiment.

An additional pressure relief valve 22 that serves the pressure backup on a malfunction and is not involved in the function of the hydraulic system or of the fall-back support in normal operation is furthermore provided in the blocked region of the hydraulic system 10.

The substantive advantages of the hydraulic system 10 in accordance with the invention can be summarized as follows overall:

An energy requirement for the supply of the fall-back support function is only necessary when the fall-back support cylinder 12 is extended. This is only the case in the operation of the work machine 1 on "Lower boom" or in an optionally provided installation operation.

Minimal movements of the boom 4 that occur externally due to a force exertion are compensated by the hydraulic store 20 to thus ensure a fall-back support function.

The control methods and routines disclosed herein may be stored as executable instructions in non-transitory memory and may be carried out by the control system including the controller in combination with the various sensors, actuators, and other work machine hardware. Further, the described actions, operations and/or functions may graphically represent code to be programmed into non-transitory memory of the computer readable storage medium in the work machine, where the described actions are carried out by executing the instructions in a system including the various work machine hardware components in combination with one or more controllers.

REFERENCE NUMERAL LIST

1 work machine
2 undercarriage with chassis
3 superstructure
4 boom
5 retraction rope
6 setting device (retraction winch)
7 load suspension means (load hook)
8 hoist rope
9 hoist winch
10 hydraulic system
12 fall-back support cylinder
14 hydraulic pump
15 motor
16 stop valve
18 load-bearing cylinder space
19 non-load bearing cylinder space
20 hydraulic store
22 pressure relief valve
24 check valve
26 valve (directional valve)
28 pressure sensor
30 pressure relief valve
32 switching valve
34 shuttle valve
36 tank
50 consumer
M load torque

The invention claimed is:

1. A hydraulic system for operating a hydraulic fall-back support of a work machine comprising:

at least one hydraulic fall-back support cylinder for tracking and limiting movements of a boom of the work machine; and a hydraulic pump by means of which the fall-back support cylinder and at least one further hydraulic consumer can be supplied with hydraulic fluid;

wherein a stop valve having a blocking position and a passage position are connected between the hydraulic pump and the fall-back support cylinder, by means of which stop valve a load-bearing cylinder space of the fall-back support cylinder is blockable; and wherein a hydraulic store connected to the load-bearing cylinder space is provided between the stop valve and the fall-back support cylinder; and wherein the stop valve is hydraulically controllable by means of a switching valve.

2. The hydraulic system in accordance with claim 1, wherein at least two fall-back support cylinders are provided each having a check valve and a hydraulic store that can together be supplied with hydraulic fluid by the hydraulic pump.

3. The hydraulic system in accordance with claim 1, wherein a pressure relief valve is provided between the stop valve and the fall-back support cylinder.

4. The hydraulic system in accordance with claim 1, wherein a check valve is provided that blocks a region of the hydraulic system blockable by the stop valve in a direction of the hydraulic pump, with the check valve connected in parallel with the stop valve or only acted on in the blocking position of the stop valve.

5. The hydraulic system in accordance with claim 1, wherein a further valve is arranged between the stop valve and the hydraulic pump.

6. The hydraulic system in accordance with claim 5, wherein the further valve is a directional valve that is electrically switchable.

7. The hydraulic system in accordance with claim 1, wherein a load of the fall-back support cylinder can be sensed by means of a load measurement device comprising a pressure sensor arranged between the stop valve and the fall-back support cylinder.

8. The hydraulic system in accordance with claim 1, wherein a pressure setting device is provided by means of which the pressure and a conveying amount to and from the fall-back support cylinder are settable and can be regulated in dependence on a sensed load of the fall-back support cylinder.

9. The hydraulic system in accordance with claim 8, wherein the pressure setting device comprises a recuperation device at/in the fall-back support cylinder, at least one pressure relief valve arranged between the stop valve and the hydraulic pump, a load sensing arrangement, and/or a means for controlling a further valve arranged between the pressure relief valve and the hydraulic pump.

10. The hydraulic system in accordance with claim 1, wherein the switching valve is electrically controllable.

11. The hydraulic system in accordance with claim 1, wherein the hydraulic store is configured to compensate very small movements of the fall-back support cylinder with the load-bearing cylinder space blocked by the stop valve by removing and discharging hydraulic fluid.

12. A hydraulic system for operating a hydraulic fall-back support of a work machine comprising:

at least one hydraulic fall-back support cylinder for tracking and limiting movements of a boom of the work machine; and a hydraulic pump by means of which the fall-back support cylinder and at least one further hydraulic consumer can be supplied with hydraulic fluid;

wherein a stop valve having a blocking position and a passage position are connected between the hydraulic pump and the fall-back support cylinder, by means of which stop valve a load-bearing cylinder space of the fall-back support cylinder is blockable; and wherein a hydraulic store connected to the load-bearing cylinder space is provided between the stop valve and the fall-back support cylinder; and wherein the stop valve is hydraulically controllable and has a control connection that is connected to an output of a hydraulic shuttle valve.

13. The hydraulic system in accordance with claim 12, wherein an input of the shuttle valve is connected to a non-load bearing cylinder space of the fall-back support cylinder and with a second input being connected to a switching valve that is electrically controllable.

14. A work machine, comprising a pivotable boom, a setting device for adjusting the boom, at least one fall-back support cylinder connected to the boom and following its movements, and a hydraulic systems;

wherein a control is provided by means of which a stop valve and the setting device are indirectly or directly controllable and that are configured to switch the stop valve into a passage position on actuation of the setting device; and wherein a further valve is arranged between the stop valve and a hydraulic pump and one check valve per fall-back support cylinder, with the control being configured to receive a signal for actuating the setting device from an input unit to move the boom, to thereupon switch the valve into a passage position, and to leave the stop valve in a blocking position, to switch the stop valve into the passage position after opening the check valve, and to subsequently actuate the setting device.

15. The work machine in accordance with claim 14, wherein the stop valve is in the blocking position when the boom is not actively moved by means of the setting device.

16. The work machine in accordance with claim 14, wherein the work machine is a mobile crane or cable excavator.

* * * * *